United States Patent [19]

Winston

[11] Patent Number: 4,555,276

[45] Date of Patent: Nov. 26, 1985

[54] HIGH DENSITY PRESSURE RESISTANT INVERT BLASTING EMULSIONS

[75] Inventor: Scott Winston, Budd Lake, N.J.

[73] Assignee: Hercules Incorporated, Wilmington, Del.

[21] Appl. No.: 666,070

[22] Filed: Oct. 29, 1984

[51] Int. Cl.[4] ..... C06B 45/32

[52] U.S. Cl. ..... 149/6; 149/21; 149/38; 149/40; 149/41; 149/42; 149/43; 149/44; 149/45; 149/96; 149/97; 149/114

[58] Field of Search ..... 149/6, 21, 38, 40, 41, 149/42, 43, 44, 45, 96, 97

[56] References Cited

U.S. PATENT DOCUMENTS

| | | | |
|---|---|---|---|
| 3,161,551 | 12/1964 | Egly | 149/46 |
| 3,235,423 | 2/1966 | Ferguson | 149/38 |
| 3,331,717 | 7/1967 | Cook et al. | 149/38 |
| 3,356,547 | 12/1967 | Berthmann et al. | 149/51 |
| 3,447,978 | 6/1969 | Bluhm | 149/2 |
| 3,770,522 | 11/1973 | Tomic | 149/2 |
| 4,111,727 | 9/1978 | Clay | 149/46 |
| 4,141,767 | 2/1979 | Sudweeks et al. | 149/2 |
| 4,338,146 | 7/1982 | Granlund | 149/109.6 |
| 4,356,044 | 10/1982 | Jessop et al. | 149/2 |

*Primary Examiner*—Stephen J. Lechert, Jr.

[57] ABSTRACT

A method of minimizing deep hole pressure effects on ammonium nitrate-containing blasting agents while optimizing booster sensitivity, detonation rate and detonation energy of such agents, by replacing density control component(s) with a sensitizer formulation comprising particulate aluminum and particulate smokeless powder; and a corresponding detonatable high density emulsion blasting agent utilizing such sensitizing formulation.

17 Claims, No Drawings

HIGH DENSITY PRESSURE RESISTANT INVERT BLASTING EMULSIONS

The present invention relates to a method for minimizing deep hole pressure effect through the use of high density emulsion-type blasting compositions capable of optimizing desirable but essentially incompatible characteristics inclusive of sensitivity, detonation rate, and specific energy, without the expense and inherent technical limitations of occluded gas or similar density control agents; plus the corresponding high density blasting composition utilizing, as an active component, a modified sensitizing formulation.

BACKGROUND

Within the last few decades there has been a substantial shift in demand away from traditional explosive compositions such as TNT, dynamite, and nitroglycerin for hard rock mining, excavation, and similar commercial blasting, in favor of cheaper, readily available inorganic salts such as prilled ammonium nitrate (AN) and also mixtures of such salt with other inorganic oxygen-supplying salts and an organic fuel or oil (ANFO).

Such formulations are relatively inexpensive and, when desired, can be manufactured "in situ" in relative safety compared with most traditional explosives, to avoid a number of problems generally associated with long term explosive storage and transportation.

When the bore hole is very deep and/or wet, however, AN and ANFO formulations are less attractive since they are easily desensitized and must be protected (a) by special packaging with attendant cost and oxygen-balance problems, or (b) by the addition of expensive coatings, thickeners or gelling agents, and the like. Moreover, ANFO has a somewhat limited specific energy due to low bulk density.

Some of the above-listed problems are partially avoidable by using special slurries having higher bulk densities, but such formulations are still not water proof, and must rely heavily upon gassification or other known density control means to retain even a minimally acceptable level of sensitivity. Pressure conditions within deep bore holes, for example, cause compression of gas voids, often resulting in retention of unexploded charges in difficult-to-reach areas where further drilling, mining or excavation may be necessary.

A substantial breakthrough with respect to moisture resistance is described, for instance, in U.S. Pat. No. 3,161,551 of Egly; here a water-resistant blasting agent is obtained having at least one solid prilled inorganic salt such as "AN" and a 50-70% AN aqueous solution as the aqueous discontinuous phase of an invert emulsion; such agent utilizes carbonaceous fuel oil and an emulsifier, such as a long chain fatty acid or ester derivatives thereof, to form the continuous external hydrophobic phase of the emulsion.

Egly's class of compositions exhibits improved resistance to water because the invert water-in-oil emulsion has the capacity to fill natural voids in the solid prilled inorganic salt component and water cannot easily force its way through the continuous external hydrophobic emulsion phase. Balanced against such advantage, however, are serious sensitivity and storage problems which may be due, in part, to a tendency of the solid oxidizer salt component to promote or encourage desensitizing crystallization within the discontinuous aqueous phase during storage.

Additional variations in the use of oxidizer salts are noted, for instance, in Wade (U.S. Pat. Nos. 4,149,916; 4,110,134) Sudweeks (U.S. Pat. No. 4,322,258) and Jessop (U.S. Pat. No. 4,356,044). Generally speaking, however, such compositions also tend to be deficient in sensitivity characteristics.

Bluhm (U.S. Pat. No. 3,447,978) seeks to avoid Egly's lack of sensitivity through the use of, at least, 4% by volume of occluded or entrained gas within an invert emulsion system consisting essentially of (1) known water-in-oil emulsifier;

(2) a discontinuous ammonium nitrate aqueous phase (optionally supplemented by other water soluble oxidizer salts) within a continuous organic phase consisting of a carbonaceous fuel having the required predetermined gasretaining consistency at 70° F.; and (3) the functionally important occluded gas itself inclusive of air or glass bubbles and the like, as a density control agent.

Bluhm's explosive compositions, while capable of avoiding some of the above-listed deep wet-bore hole problems, also suffer from certain stability, sensitivity, and potential pollution problems because the proportion, by weight, of discontinuous aqueous-phase to continuous organic phase must be high in order to even approximate a satisfactory Oxygen Balance.

In the Tomic Patent (U.S. Pat. No. 3,770,522), gas bubbles and other density control agents such as microballoons are required along with a stearate salt as a special emulsifier, plus aluminum, magnesium, and smokeless powder as supplementary fuels in an emulsion-type explosive composition. Such compositions, however, do not produce the desired high volume-energy range.

Efforts to eliminate density control agents such as entrained gases and microballoons in order to increase specific energy output and to reduce cost, have not been commerically satisfactory thus far, because of the general lack of sensitivity of dense AN emulsions, particularly those exceeding about 1.3 gm/ml; moreover, the use of temperature-sensitive explosive sensitizers such as nitroglycerin or formulations containing nitroglycerin generally increase sensitivity at the expense of very desirable safe handling characteristics normally expected of emulsion blasting agents. Sensitizer-activated compositions known to the art are described, for instance, in Berthmann et al (U.S. Pat. No. 3,356,547).

It is an object of the present invention to optimize volume energy and sensitivity of high density invert emulsion blasting compositions substantially lacking in void-producing density control agents while retaining the excellent formulation, handling, and safety characteristics generally attributable to water-in-oil emulsion blasting compositions by adding an effective amount of a modified sensitizing formulation.

If is a further object to optimize volume-energy release characteristics and resistance to deep hole pressure effects while retaining desired sensitivity.

THE INVENTION

The above objects are obtained by utilization of a high density emulsion blasting composition comprised of (A) a water-in-oil emulsion component comprising a continuous hydrophobic organic phase, a discontinuous aqueous phase containing at least one soluble inorganic oxidizer salt, and an emulsifier of the water-in-oil type; and (B) an effective amount of a sensitizing formulation comprising (1) particulate aluminum, and (2) particulate smokeless powder, in which the ratio of (1) to (2) in said formulation is about 0.5–10 to 1–40 and preferably 2–7 to 5–30 percent by weight of composition.

As such, an effective amount of sensitizing formulation can preferably vary from about 2 to 40 percent by weight based on total composition.

The term "high density" as applied to emulsion blasting compositions of the present invention, generally includes a density of not less than about 1.25 gm/ml and preferably falls within the range of about 1.30–1.45 gm/ml, the denser ranges favoring higher specific energy based on volume but requiring a somewhat higher ratio by weight of sensitizing formulation to total composition.

For purposes of the present invention, the continuous hydrophobic organic phase of the water-in-oil emulsion component usefully comprises a hydrocarbon or carbonaceous fuel which can be generally characterized as a liquid or a solid, provided the fuel is liquid under preparation conditions. Such continuous hydrophobic organic phase can vary substantially, but most usefully comprises a hydrocarbon or substituted hydrocarbon oil. Examples of such material further include, for instance, diesel oil; paraffin oils; paraffin waxes; tall oil; long chain fatty acids such as oleic acid; nitro alkanes such as nitro propane; aromatic hydrocarbons such as benzene, inclusive of substituted aromatic hydrocarbons such as toluene, xylene, nitro benzene, and the like.

The organic phase as described is generally present in sufficient amount such that combination with the aqueous phase, plus packaging or wrapping is sufficient to obtain an oxygen balance between about −20 to +30% and preferably about 0%±5% to effectively control undesired by-products. Based on weight of composition, such organic phase conveniently constitutes about 2–12% by weight of total composition.

The discontinuous aqueous phase, for purposes of the present invention, usefully comprises a concentrated aqueous solution (preferably up to about 90% by weight) of an inorganic oxidizer salt such as ammonium nitrate, alone or in combination with one or more alkali or other metal nitrates or chlorates exemplified by sodium nitrate, sodium chlorate, sodium perchlorate, calcium nitrate, calcium chlorate, calcium perchlorate, potassium nitrate, potassium chlorate, potassium perchlorate, ammonium nitrate, ammonium chlorate, ammonium perchlorate, lithium nitrate, lithium chlorate, lithium perchlorate, magnesium nitrate,, magnesium chlorate, aluminum chlorate, barium nitrate, barium chlorate, barium perchlorate, zinc nitrate, zinc chlorate and zinc perchlorate and the like.

For present purposes the amount of water in the discontinuous phase constitutes about 5–30 weight percent and preferably 10–20 weight percent of the total composition, the lower ranges (i.e. 5–20) generally providing excellent emulsion performance with regard to detonation energy and sensitivity but with some loss in storage life due to salt crystallization. For this reason the optional presence of a stabilizing amount of at least one crystal habit modifier, inclusive of one or more azo dyes such as Cyanine Acid Blue #45 and Acid Yellow #23 is found useful to modify or distort such crystals. For such purpose an amount of about 0.005–0.02% by weight is found to be sufficient.

Emulsifiers, for purposes of the present invention, can be of the usual water-in-oil type and can be used alone or in combination. Such may include, for instance, sorbitol esters such as sorbitan fatty acid esters including sorbitan monolaurate, sorbitan monooleate, sorbitan sesquioleate, and sorbitan tristerate among others. Other water-in-oil type, emulsifiers found useful for purposes of the present invention include, but are not limited to, polyoxyethylene sorbitol esters, lower alkyl esters of lanolin fatty acids such as the isopropyl ester mixtures of higher fatty alcohols and wax esters; also includable are polyalkylene ethers, substituted oxazolines and corresponding phosphate esters, to mention but a few. Mixtures of water-in-oil and oil-in-water emulsifiers may also be used as long as the resulting emulsion is of the water-in-oil type. Generally speaking, the emulsifier component can be employed in an effective amount of about 0.6–7.0 weight percent or even higher.

An effective amount of the sensitizing formulation (B component) of the present invention (as above defined) includes various combinations of particulate aluminum with particulate double-base type smokeless powder.

The aluminum component of the sensitizing formulation can be granular, atomized, or flake grade aluminum of widely varying surface area and usefully falls within a mesh size of about 16 to 100, the preferred range being about 18 to 60. Such metal particles are also usefully coated with a protective coating of wax, fatty ester, teflon, or similar material.

Preferred high purity particulate aluminum such as granular aluminum is obtainable commercially, for instance, from Almeg, Inc. of Kansas City, Mo. as Almeg H-30 TM and Almeg VFN TM Aluminum.

Particulate smokeless powder is commercially available from Hercules Incorporated under the trademarks BLUE DOT®, BULLSEYE®, GREEN DOT®, HERCO®, HERCULES 2400®, RED DOT TM, RELOADER® 7 and UNIQUE®, and can consist of various grades of double based powder, or corresponding smokeless powder fines such as Talley Fines for purposes of the present invention.

As above noted, the aluminum component usefully constitutes about 0.5–10 percent by weight, and preferably 2–7 percent by weight, based on total composition while the smokeless powder component can constitute about 1–40 weight percent, and preferably 5–30 weight percent based on total composition.

By modifying the ratio of particulate smokeless powder-to-particulate aluminum within the above percentage range, it is possible to obtain good detonation rates and sensitivity without sacrifice of worthwhile high density characteristics over a wide range, and also to obtain w/o invert emulsion blasting agents having detonation properties tailored to the many specific needs of emulsion blasting agents generally.

The following examples further describe the present invention without limiting the underlying principles or scope of the invention.

EXAMPLE 1 (Control)

58.71 parts by weight solid ammonium nitrate and 17.67 parts sodium nitrate are added to 18.62 parts water. The mixture is heated to 80° C. and stirred to dissolve the solids. In a separate mix bowl, 3.25 parts mineral oil, 1.25 parts sorbitan sesquioleate, and 0.50 parts oleic diethanolamide are blended at 80° C. The aqueous solution is slowly added to the oil phase and hand stirred to form a water-in-oil emulsion which is then thickened by pumping through a static mixer.

The resulting emulsion blasting composition is found to have a density of 1.44 g/ml at room temperature. A sample of the blasting composition is then packed into a 4"×25" polyethylene bag and routinely shot-confined and fired in a 4" diameter pipe using a 500 g booster at 40° F. The resulting measured detonation energy is found to be $0.44\times10^6$ ft lb/lb., the measured detonation rate is 2000 m/sec., and the minimum booster sensitivity found to be a 500 g/PETN. The detonation energy, rate, and sensitivity are found to be substandard for commercial purposes. The results are reported in Table I infra.

EXAMPLE 5

(A) 83 parts by weight of the emulsion of Example 1 is slowly hand blended with 2 parts high purity 16–100 granular aluminum and 15 parts smokeless powder fines as in Example 4. The resulting composition is packaged and tested as before and the results reported in Table I.

(B) The product of Example V(A) is also tested after storage at 22 psi pressurization in water for 24 hours (i.e., the equivalent of being under 50 feet of water for 24 hours) to obtain a detonation energy of $1.01\times10^6$ ft lb/lb, and a detonation rate was 4000 m/sec. to illustrate water and pressure resistance. Results are reported in Table I.

TABLE I

| Example | Density* (gm/ml) | Detonation Energy (ft. lb./lb.) | Detonation Rate (m/sec.) | Booster Sensitivity (gm/PETN) | Evaluation |
|---|---|---|---|---|---|
| 1 (Control) | 1.44 | $.44\times10^6$ | 2,000 | 500 | SS. |
| 2 | 1.42 | $.96\times10^6$ | 2,650 | 10 | G - Booster Sensitivity<br>Detonation Energy<br>P - Detonation Rate |
| 3 | 1.34 | $.93\times10^6$ | 4,250 | 225 | G - Detonation Rate<br>Detonation Energy<br>P - Booster Sensitivity |
| 4 | 1.35 | $1.00\times10^6$ | 4,650 | 10 | E |
| 5(A) | 1.36 | $.98\times10^6$ | 4,500 | — | E |
| 5(B) | — | $1.01\times10^6$ | 4,000 | — | E |

SS — substandard
P — poor
G — good
VG — very good
E — Excellent
*at Room Temperature

EXAMPLE 2

97 parts of the emulsion of Example 1, is slowly blended by hand with 3 parts by weight preferably of 20–60 mesh from Almeg, Inc. of Kansas City, Mo. mesh high purity granular aluminum until uniform. The resulting emulsion blasting composition is found to have a density of 1.42 g/ml at room temperature. A sample of this composition is then packed into a 4"×25" polyethylene bag, shot-confined in 4" diameter pipe and tested as before using a 500 g/PETN booster at 40° F. to obtain a measured detonation energy of $0.96\times10^6$ ft lb/lb., a measured detonation rate of 2650 m/sec., and a minimum booster sensitivity of 10 gm booster. The results and evaluation are reported in Table I infra.

EXAMPLE 3

85 parts of the emulsion of Example 1 is slowly hand blended with 15 parts smokeless powder fines until uniform, the resulting composition having a density of 1.34 g/ml at room temperature. The composition is then packed into a 4"×25" polyethylene bag and shot-confined in 4" diameter pipe with a 500 g booster at 40° F. as before. The test results are reported in Table I infra.

EXAMPLE 4

82 parts of the emulsion of Example 1 is slowly hand blended with 3 parts high purity 16–100 mesh aluminum and 15 parts smokeless powder fines until uniform. The resulting blasting composition, having a density of 1.35 g/ml at room temperature, is packed into a 4"×25" polyethylene bag and shot-confined in a 4" diameter pipe with a 500 g booster at 40° F. as before and tested. The test results are reported in Table I infra.

What I desire to protect by Letters Patent is:

1. A high density emulsion blasting composition of (A) a water-in-oil emulsion component comprising a continuous hydrophobic organic phase, a discontinuous aqueous phase containing at least one soluble inorganic oxidizer salt, and an emulsifier; and (B) an effective amount of a sensitizing formulation comprising (1) particulate aluminum and (2) particulate smokeless powder, in which the ratio of (1) to (2) in said formulation is about 0.5–10 to 1–40 percent by weight of composition.

2. The blasting composition of claim 1 in which the inorganic oxidizer salt is at least one member selected from the group consisting of sodium nitrate, sodium chlorate, sodium perchlorate, calcium nitrate, calcium chlorate, calcium perchlorate, potassium nitrate, potassium chlorate, potassium perchlorate, ammonium nitrate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate.

3. The blasting composition of claim 2 wherein the ratio by weight of aluminum-to-smokeless powder in the sensitizing formulation is about 2–7 to 5–30 percent by weight of composition.

4. The blasting composition of claim 2 containing 2 to 40 percent by weight of sensitizing formulation based on total composition.

5. The blasting composition of claim 2 wherein density of the composition is about 1.30–1.45 gm/ml.

6. The blasting composition of claim 2 wherein the composition contains at least one crystal habit modifier.

7. The blasting composition of claim 2 wherein the continuous hydrophobic organic phase is a carbonaceous fuel.

8. The blasting composition of claim 2 wherein the sensitizing formulation comprises granular atomized or flake aluminum together with smokeless powder fines.

9. The blasting composition of claim 8 wherein the aluminum component of the sensitizing formulation has a protective coating.

10. The blasting agent of claim 9 wherein the protective coating is a thin coating of a wax, fatty ester, or water soluble polymer.

11. In a method of optimizing volume energy and sensitivity of high density invert emulsion blasting compositions while optimizing sensitivity and detonation rate of a blasting agent containing a water-in-oil invert blasting emulsion as an active component the improvement comprising replacing densitycontrol agents with an effective amount of a sensitizing formulation comprising (1) particulate aluminum and (2) particulate smokeless powder utilized in a ratio of (1) to (2) of about 0.5–10 to 1–40 percent by weight of composition.

12. The method of claim 11 wherein the ratio of (1) to (2) in the formulation is 2–7 to 5–30 percent by weight.

13. The method of claim 11 wherein the blasting composition uilitizes as soluble inorganic oxidizer salt, a member selected from the group consisting of sodium nitrate, sodium chlorate, sodium perchlorate, calcium nitrate, calcium chlorate, calcium perchlorate, potassium nitrate, potassium chlorate, potassium perchlorate, ammonium nitrate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate.

14. The method of claim 11 wherein sufficient sensitizing formulation is used to obtain a composition density of about 1.30–1.45 gm/ml.

15. The method of claim 11 wherein the sensitizing formulation utilized comprises about 2–45 weight percent based on total blasting composition.

16. The method of claim 11 wherein the particulate aluminum of the sensitizing formulation is granular, atomized, flake grade, or combinations thereof, and the smokeless powder is in the form of fines.

17. The method of claim 16 wherein the aluminum component of the sensitizing formulation has a protective coating of a wax, fatty ester or water soluble polymer.

* * * * *